US006647563B1

(12) United States Patent
Smith

(10) Patent No.: US 6,647,563 B1
(45) Date of Patent: Nov. 18, 2003

(54) ATTACHMENT SYSTEM FOR BATHING ENCLOSURE SEGMENTS

(75) Inventor: Iain M. Smith, Vernon (CA)

(73) Assignee: Kohler Canada Co./Compagnie Kohler Canada, Toronto (CA)

( * ) Notice: Subject to any disclaimer, the term of this patent is extended or adjusted under 35 U.S.C. 154(b) by 0 days.

(21) Appl. No.: 10/205,681

(22) Filed: Jul. 25, 2002

(51) Int. Cl.[7] ..... A47K 3/02
(52) U.S. Cl. ..... 4/584; 4/6; 4/12
(58) Field of Search ..... 4/584, 596, 612; 52/582.1

(56) References Cited

U.S. PATENT DOCUMENTS 3,705,471 A 12/1972 Allen
4,316,295 A 2/1982 Whitney et al.
4,471,501 A 9/1984 Heymann
4,578,832 A 4/1986 Primucci
4,901,380 A * 2/1990 Smith ..... 4/596
5,263,208 A 11/1993 Smith
5,896,715 A 4/1999 Maupas

* cited by examiner

*Primary Examiner*—Charles E. Phillips
(74) *Attorney, Agent, or Firm*—Quarles & Brady LLP

(57) ABSTRACT

Bathing enclosures, and methods for assembling them, are disclosed. They are provided with connectors in the form of first and second supports, a clip, and a fastener. The supports are mounted on the upper and lower portions of the enclosure respectively and have through bores and an outer projection. The clips attach on the exterior of the projections to align the supports. The fastener such as a bolt passes through the through bores to clamp the supports together. The clips permit one set of supports to be aligned and loosely bolted together while another set of supports are held apart by a washer in order to provide a defined gap for caulking with silicone or other sealant.

10 Claims, 2 Drawing Sheets

ATTACHMENT SYSTEM FOR BATHING ENCLOSURE SEGMENTS

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to shower enclosures, shower/tub enclosures, saunas and other walled bathing enclosures. More particularly, it relates to assemblies used to align and connect sections of such enclosures.

Bathing enclosures are often provided with tiled surrounding walls. However, the process of creating tiled walls is labor intensive, time consuming and requires considerable skill (and thus can be quite costly).

A lower cost alternative is to create a prefabricated enclosure from a plastic or other suitable material at a factory and then transport the enclosure to the installation site. However, many shower stalls are 48 to 60 inches wide. Further, combined bathtub/shower enclosures are now increasingly popular. Some of such structures, if formed and transported as a single piece, may be too big to fit into elevators or through conventional doorways. This makes it impossible for them to be used to replace existing plumbing in completed buildings, and greatly restricts what stage of construction the products must be delivered. In any event, the larger the product, the more difficult it is to carry up stairways or elsewhere.

Thus, the art developed "knockdown" type enclosures that are formed in multiple pieces that can be assembled on-site from smaller components. See e.g. U.S. Pat. Nos. 4,316,295, 4,471,501, 4,578,832, and 5,263,208, and Canadian patent 1,276,404. These enclosures may be shipped in separate pieces, or they may be shipped as a single structure and then disassembled immediately before bringing them into buildings.

A designer of such enclosures must address how to avoid leaks at the seams between sections, how to align clamping elements together with a minimal number of workers and within a minimum amount of time, and the cost of creating the attachment members adjacent the seams. Further, long term reliability of the attachment mechanism is critical.

In systems where blocks are attached to separate upper and lower sections and then bolted together (e.g. U.S. Pat. Nos. 4,471,501 and 4,578,832) it can be difficult to manually align the component enclosure sections to a sufficient degree so that the walls of the sections are flush and so that bolts can be easily inserted into holes within the blocks/brackets. This may require two or more workers to repetitively adjust the alignment until all the bolts can be inserted. In certain circumstances it is sufficiently difficult to align the existing holes of the blocks that new holes must be drilled in the blocks for the bolts.

Alternatively, in a system like Canadian patent 1,276,404, where the blocks of the upper panel must be slid onto guide pins projecting up from the lower blocks, it is necessary to blindly fit the shafts of the upper blocks onto the guide pins. There may be considerable difficulty in achieving proper alignment, particularly if panel sections have warped slightly.

U.S. Pat. No. 5,263,208 sought to address a number of these design concerns, and made substantial progress in that regard. However, the system disclosed in that patent required three different types of connection structures (a locator, a clamp and a separate alignment system). Also, the assembly was somewhat less intuitive than other systems, and further had somewhat higher cost than was optimal.

As such, a need still exists for improved systems for assembling "knockdown" type shower stalls.

SUMMARY OF THE INVENTION

In one aspect the present invention provides a bathing enclosure of the type having a multi-piece plumbing fixture wall structure. The structure has a first portion and a second portion (e.g. an upper section of enclosure walls and a lower section of a portion of the enclosure wall with a bathtub). The first portion has walls with edges which can be essentially aligned with opposed edges of walls of the second portion so as to define a seam there between.

The improvement of the present invention is that there is now a series of clamping/alignment components which facilitate the alignment and secure connection of the structure portions. There is a first support having a base mounted on the first portion of the wall structure, the first support having an internal channel extending there through and an outward projection. There is also a second support having a base mounted on the second portion of the wall structure, the second support also having an internal channel extending there through and an outward projection.

There is also a clip that is positionable over both the outward projection of the first support and the outward projection of the second support when the internal channel of the first support and the internal channel of the second support are essentially aligned. A preferred way of such positioning is to slide the clip along a vertical axis of both the supports.

There is also a fastener capable of being positioned in both the internal channel of the first support and the internal channel of the second support when the channels are so essentially aligned. This clamps the wall structure portions together, and can also optionally be used to loosely anchor the wall structure parts while the upper portion is being raised to provide a gap for adding silicone or other sealant to the seam between the upper and lower parts.

In preferred forms the outer projections are essentially C-shaped in cross section and the clip is essentially C-shaped in cross section, the internal channels both have a plurality of inwardly directing projections, and the clip and supports interfit using inward protrusions and notches.

In another preferred form both bases have feet sections that mount against the respective wall structure portions. There is an opening along the respective lengths of the internal channels between the respective feet of the respective supports. The fastener is in the form of a bolt having an enlarged head, a threaded end opposite from the head, and a clamping nut threadable on the opposite end.

In another form the invention provides a method of assembling a first portion and a second portion of a bathing enclosure together. One obtains the above enclosure, where there is also a second set of such supports, clip and fastener, and positions the wall structures in rough alignment. One then inserts the fastener in one set of supports and a washer between another set of supports.

The present system is designed to allow the clips to drive the supports into proper alignment, while allowing some relative movement of the upper section of the wall structure with respect to the lower section (until the final bolting is completed). Only one type of fastener assembly is needed, thereby reducing the number of parts needed.

The bathing enclosure is relatively inexpensive to manufacture, creates a tight, leak-proof seam, and is designed to be reliable on a long term basis.

The foregoing and other advantages of the invention will be evident from the following description. In the description, reference should be made to the accompanying drawings which form a part of the disclosure. Such embodiments and the description thereof do not, however, represent the full scope of the invention. Rather, the claims should be looked to for interpreting the full scale of the invention.

DETAILED DESCRIPTION OF THE PREFERRED EMBODIMENT

Figures 1, 2:
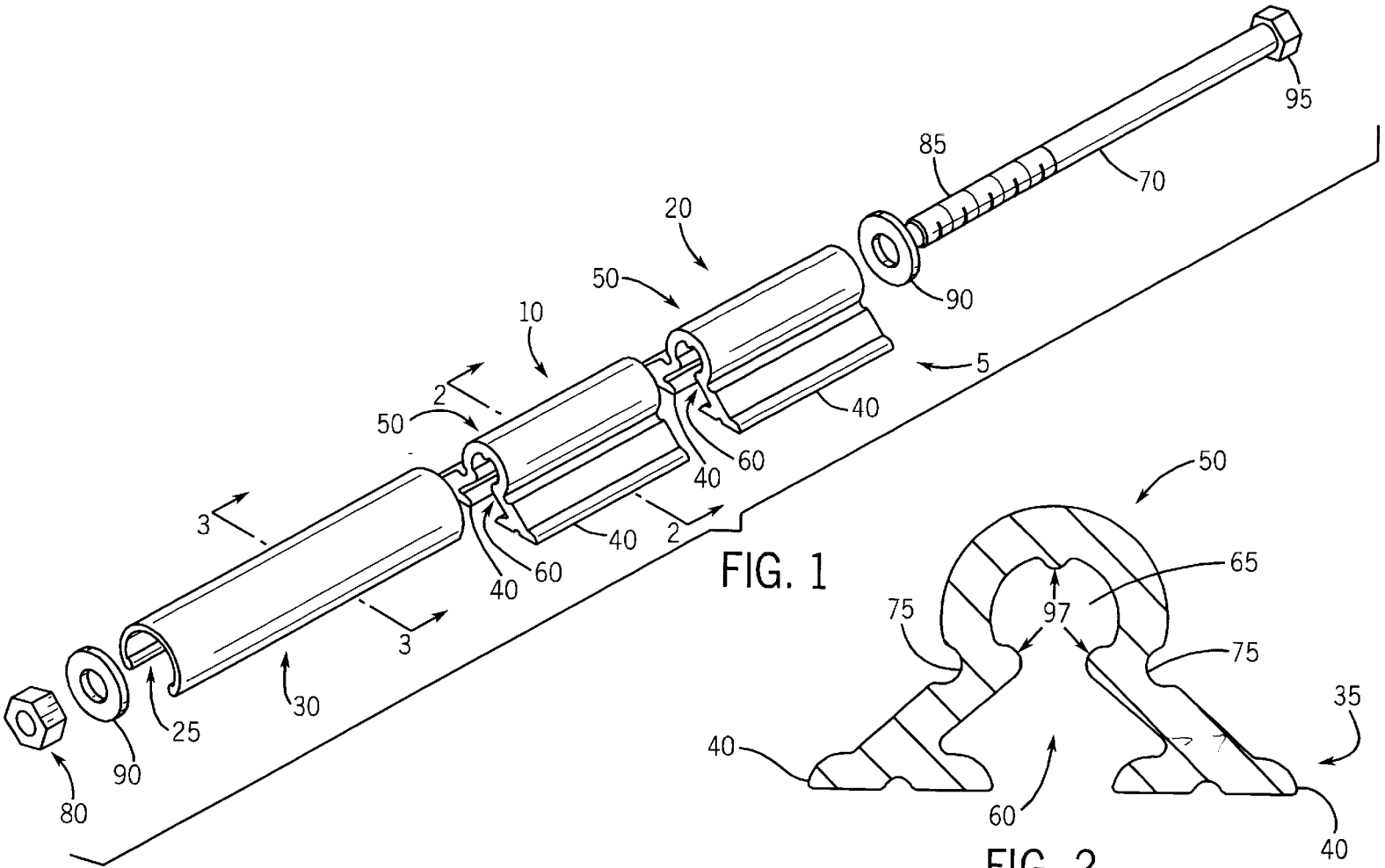
FIG. 1 is an exploded perspective view of components of the system of the present invention that can be used to connect bathing enclosure portions together.
FIG. 2 is a cross-sectional view taken along line 2—2 of FIG. 1.
Figure 3:
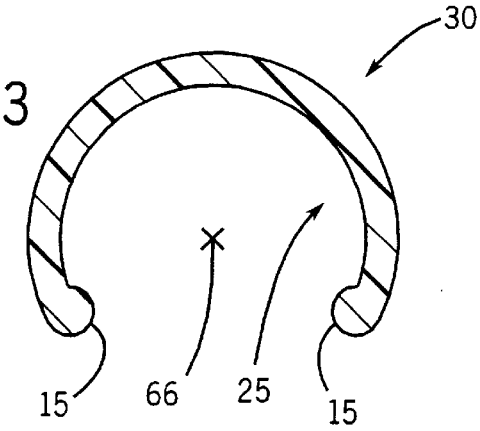
FIG. 3 is a cross-sectional view taken along line 3—3 of FIG. 1.

Referring first to FIG. 1, a clamping/aligning device 5 is provided. There are extruded plastic supports 10, 20 and a generally C-shaped clip 30. The supports are to be fastened to respective surfaces of a bathing enclosure, along respective edges of the surfaces that are intended to interface one another. For example, in FIG. 4 there are shown panels 100 and 102 (e.g., an upper wall of a shower enclosure and a lower wall of the same shower enclosure). More than one (and often twelve or more) of the devices 5 are used with any given cut line between two sections of any given enclosure.

Referring next to FIG. 2, the support 10 has a base 35 with two feet 40. The feet 40 are designed to be glued on, glassed on, or otherwise attached to the respective side walls of the enclosure. In the most preferred form, a single unitary member comprising the length of supports 10 and 20 is glassed onto a shower stall. Both the shower stall and the support piece is then cut into two to yield the two enclosure portions with the separate pieces 10 and 20 now formed.

Alternatively, one could provide locator notches on the outer surface of the shower enclosure walls to help locate the feet. However, this is not necessary in all cases.

In any event, feet 40 of the base 35 support a convex outer projection 50, which is essentially C-shaped. There is an inner cavity 60 that extends from between the feet 40 to within the projection 50. A portion of the inner orifice 60 within the projection 50 is also substantially C-shaped in cross-section, and essentially forms a cylindrical conduit 65 extending the entire length of the support 10 along a longitudinal axis 66. There is also a C-shaped clip 30 having inner surface 25 complementary to the projections 50 of the first and second supports 10, 20.

When the clamping system is being assembled, first and second supports 10, 20 are positioned end-to-end in rough vertical alignment. The C-shaped clip 30 then can slide down onto the projections 50. The supports 10, 20 and the C-shaped clip 30 are made from a relatively inflexible plastic or other material (or simply are not very flexible because of their rather thick dimensions). Nevertheless, the C-shaped clip 30 typically has some minimal flexibility so that the clip can be easily slid onto neighboring supports 10,20 even when those supports are slightly out of alignment.

The C-shaped clip 30 includes inward protrusions 15 along edges of the clip. The inward protrusions 15 are designed to fit within notches 75 along the sides of supports 10, 20, between the respective projections 50 and feet 40. Because the concave inner surface 25 and the convex projection outer surfaces 50 are generally complementary in shape, and also because of the interfacing of the inward protrusions 15 and notches 75, the C-shaped clip 30 can tend to drive the projections 50 into even closer alignment. In certain embodiments, the protrusions 15 are tapered near the ends of the C-shaped clip 30 so that effectively the protrusions are reduced or nonexistent at the very ends of the clip. This can facilitate the sliding of the C-shaped clip 30 on and off of the projections 50.

Also, the clip 30 limits transverse motion of the parts relative to each other. This thus serves the purpose of both achieving alignment, and then maintaining it through the bolting process.

In this regard, a bolt 70 can be inserted into and through the cylindrical conduits 65 of the respective supports once the supports are properly aligned. Then, the enlarged bolt head 95 will rest on the top support and a washer and nut 80/90 can be used to clamp the parts together. An additional washer 90 is inserted between the bolt head 95 and the top of the upper support. In some embodiments, the washers 90 restrict movement of the C-shaped clip 30 to prevent movement of the clip off of the projections 50. While it is primarily the interaction of the C-shaped clip 30 and supports 10,20 that provides for alignment, the tightening of the bolt 70 and nut 80 further reinforces this alignment.

As shown particularly in FIG. 2, the cylindrical conduits 65 in the present embodiment can have three inward protrusions 97 that provide support for the bolt 70 and limit movement of the bolt relative to the cylindrical conduits. In alternate embodiments, such protrusions can be slightly flexible to assist the connection where the supports are still slightly out of alignment.

The bathing enclosure typically is shipped in assembled form (albeit with spacer washers positioned on the bolts 70 in between the supports 10,20 to prevent the scraping of adjoining sections of the bathing enclosure during transit) to an installation site, where it can be disassembled to fit through small doorways. For example, the nuts can be removed from the bolts and the bolts removed. A hammer can then be used to dislodge the C-shaped clips 30 from each of the pairs of supports.

Figure 4:
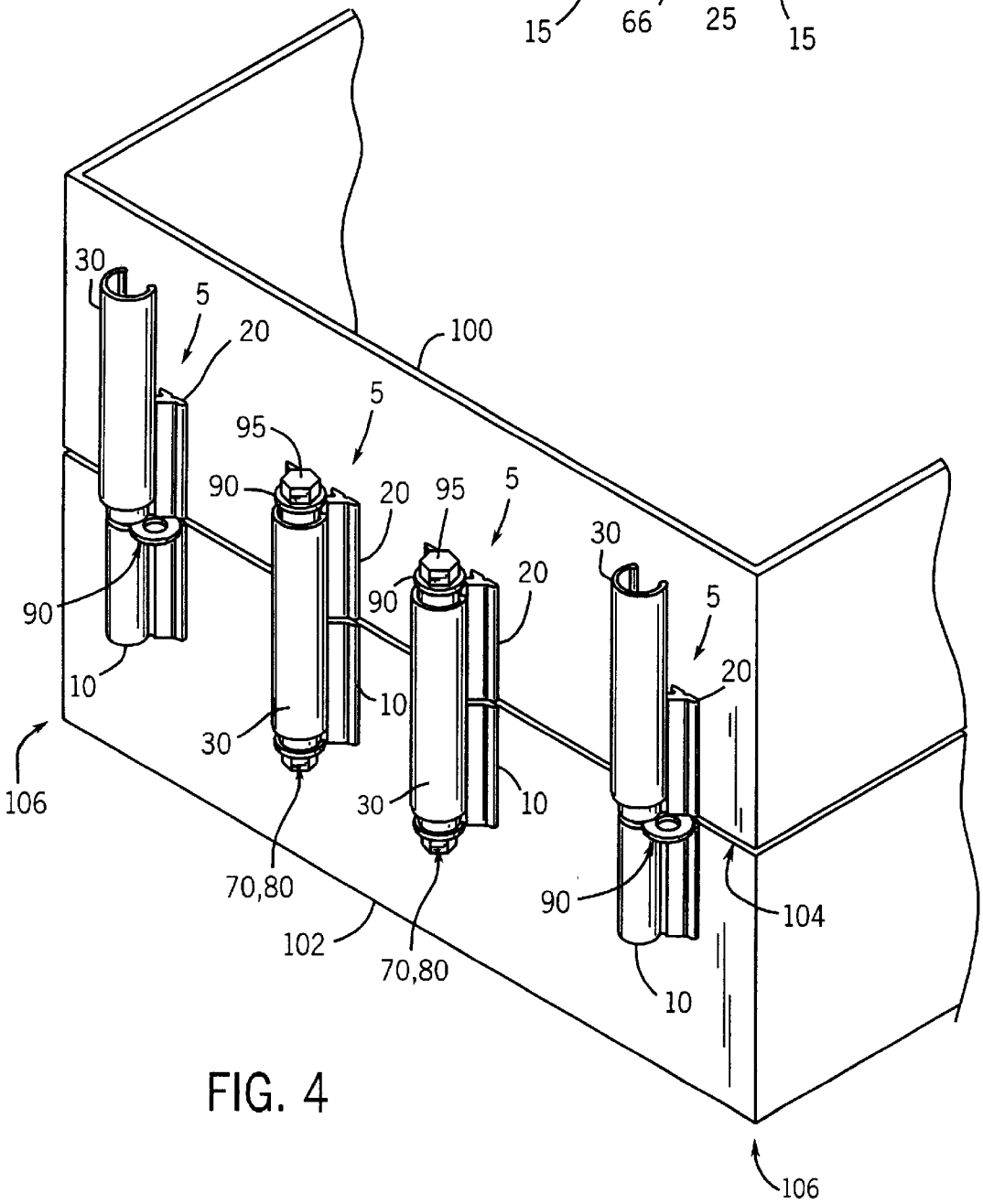
FIG. 4 is a perspective view of exemplary panel components of a bathing enclosure on which several of the devices of the type shown in FIG. 1 are mounted at various stages of assembly.

A preferred method of assembly is described with reference to the FIG. 4 embodiment. The portions 100 and 102 can be positioned in rough alignment to thereby move all of the upper supports 20 in rough alignment with the lower supports 10. Multiple such attachment assemblies (e.g. four for a side of the wall) will typically be provided. A greater number of such clamping systems is typically needed at locations such as door columns and corners.

Next, the C-shaped clips 30 are slid onto the supports 20, and in the case of a subset of the clips all the way down to supports 10. Because the C-shaped clips 30 are slightly flexible, the clips can be slid onto the supports 10, 20 even if the pairs are not perfectly aligned. However, because the C-shaped clips 30 are also elastic and resilient, and not very flexible, they tend to bring the supports into better alignment. Typically, once multiple clips 30 are slipped onto multiple sets of supports 10,20 along interfacing edges of adjoining sections of the bathing enclosure, the clips cooperate with one another to more perfectly align the respective pairs of supports 10,20 and adjoining sections.

After the C-shaped clips 30 are on the supports, the bolts 70 are inserted into the cylindrical conduits 65 of at least some of the aligned upper and lower supports. Washers 90 may also be used, and the nuts 80 are then affixed onto those bolts.

At this time, the nuts 80 are only partly turned onto the bolts 70 such that the bolts are only loosely suspended in the cylindrical conduits 65 by the heads 95 of the bolts. The upper wall structural portion is then raised in relation to the lower wall structural portion to create a slight gap 104 in between the panel components. Because of the C-shaped clips 30 and the bolts 70 at some of the attachment locations, the upper portion 100 can be raised in a controlled manner such that the essential alignment of the components is generally maintained. With the gap 104 thus exposed with respect to the devices not having the bolt yet, a washer or other spacing device can then be positioned into the gap 104 to maintain the gap so that sealant such as caulking or silicone can be directed into the gap.

In alternate embodiments, bolts 70 with nuts 80 affixed thereto can be positioned within each of the attachment locations, and spacing devices can be used to separate each of the pairs of respective supports 10,20.

Once the sealant has been applied, the washers 90 can be removed so that the upper panel component 100 again rests upon the lower panel component 102 (with the sealant in between). At this time, the C-shaped clips 30 that were previously slid onto the supports that did not have the bolts can be slid all the way down onto the corresponding supports. The bolts 70, nuts 80 and washers 90 corresponding to those devices 5 can then be assembled. At this time, all of the nuts 80 associated with each of the devices 5 (e.g., all four of the devices shown in FIG. 4) should be tightened to complete the clamping.

The present system and method are suitable for a wide variety of bathing enclosures. While horizontal seams are depicted, the system could also be used with a vertical seam structure. Also, the bathing enclosure could be split into more than two sections (compare Canadian patent 1,276,404). As such, the preceding preferred embodiments are not to be construed as the sole embodiments covered by the claims.

The present invention has many advantages. The upper panel needs to be roughly aligned with the lower one before it can be set down on the lower one. This greatly simplifies handling and minimizes the number of workers needed to manipulate the parts at this point.

Because the C-shaped clips 30 are somewhat flexible, the clips can be slid over the outer projections on the supports even when those outer surfaces are slightly out of alignment. Further, once in position, the natural tendency of the C-shaped clips 30 is to bring the convex outer surfaces of the projections 50 into more exact alignment.

Additionally, the system provides a temporary loose connection to keep relative alignment when the upper section is raised in order to insert a silicone stream between the sections. The clamping fasteners themselves are extremely inexpensive and reliable. If desired, the gap between the sections can be retained with washers positioned between some of the pairs of supports while the others are bolted.

INDUSTRIAL APPLICABILITY

The invention provides knockdown type shower stalls and other bathing enclosures provided with improved alignment and clamping systems.

I claim:

1. In a bathing enclosure of the type having a multi-piece plumbing fixture wall structure having a first portion and a second portion, said first portion having walls with edges which can be essentially aligned with opposed edges of walls of the second portion so as to define a seam there between, the improvement comprising:

a first support having a base mounted on the first portion of the wall structure, the first support having an internal channel extending there through and an outward projection;

a second support having a base mounted on the second portion of the wall structure, the second support also having an internal channel extending there through and an outward projection;

a clip positionable over both the outward projection of the first support and the outward projection of the second support at the same time when the internal channel of the first support and the internal channel of the second support are essentially aligned; and a fastener capable of being positioned in both the internal channel of the first support and the internal channel of the second support at the same time when the channels are so essentially aligned to facilitate the clamping of the wall structure portions together.

2. The bathing enclosure of claim 1, wherein when the clip is positioned over both such outward projections the supports may still slide away from each other inside the clip until the fastener clamps the supports together tightly.

3. The bathing enclosure of claim 1, wherein the outer projections are essentially C-shaped in cross section and the clip is essentially C-shaped in cross section.

4. The bathing enclosure of claim 1, wherein the internal channels both have a plurality of inwardly directing projections.

5. The bathing enclosure of claim 1, wherein:

the clip has first and second edges at which are positioned first and second inward protrusions, respectively; and at least one of the supports has notches on opposite sides adjacent a base to receive the inward protrusions;

whereby when the clip is assembled on the supports it restricts transverse movement of the supports in relation to one another.

6. The bathing enclosure of claim 1, wherein both bases comprise a plurality of feet, with the feet of the first support base mounted against the first portion of the fixture wall structure and the feet of the second support base mounted against the second portion of the fixture wall structure.

7. The bathing enclosure of claim 6, wherein an opening exists along a respective length of each of the internal channels between the respective feet of the respective support.

8. The bathing enclosure of claim 1, wherein the fastener is in the form of a bolt having an enlarged head, a threaded opposite end from the head, and a clamping nut threadable on the threaded opposite end.

9. A method of assembling a first portion and a second portion of a bathing enclosure together, the method comprising:

obtaining a claim 1 enclosure which has a first set of such supports, clip and fastener, and a second sets of such supports, clip and fastener;

positioning the supports of the first portion of the enclosure adjacent the supports of the second portion of the enclosure, so that they are in rough alignment with each other;

using one of the clips to improve the alignment of the supports;

loosely bolting one of the supports on the first portion to one of the supports on the second portion with such a fastener and once that is done moving the first portion of the enclosure slightly away from the second portion; and caulking a seam between the first and second portion.

10. The method of claim 9, comprising the further step of inserting a washer between one set of the supports immediately prior to the caulking step.

* * * * *